United States Patent [19]

van der Meulen

[11] Patent Number: 5,022,256

[45] Date of Patent: Jun. 11, 1991

[54] CLAMPING DEVICE

[75] Inventor: Jan van der Meulen, Eefde, Netherlands

[73] Assignee: Machinefabriek Wila B.V., Lochem, Netherlands

[21] Appl. No.: 414,777

[22] Filed: Sep. 29, 1989

[30] Foreign Application Priority Data

Sep. 29, 1988 [NL] Netherlands ..... 8802402

[51] Int. Cl.[5] ..... B21D 37/14

[52] U.S. Cl. ..... 72/481; 72/462; 72/389; 269/25; 269/32; 269/238; 269/275; 269/277

[58] Field of Search ..... 269/25, 32, 238, 254 R, 269/275, 277; 72/389, 462, 481, 482

[56] References Cited

U.S. PATENT DOCUMENTS

| | | | |
|---|---|---|---|
| 1,476,188 | 12/1923 | Shaw | 269/32 |
| 2,604,739 | 7/1952 | Evans | 269/254 R |
| 2,703,594 | 3/1955 | Slinkard | 269/254 R |
| 2,813,559 | 11/1957 | Kennedy | 269/254 R |
| 2,956,813 | 5/1976 | Shigeno | 269/254 R |
| 4,506,538 | 3/1985 | Jones, Jr. | 72/481 |
| 4,845,899 | 7/1989 | Dashevsky | 269/277 |

FOREIGN PATENT DOCUMENTS

| | | | |
|---|---|---|---|
| 3136440 | 9/1981 | Fed. Rep. of Germany . | |
| 3524694 | 1/1987 | Fed. Rep. of Germany | 72/389 |
| 2609909 | 1/1987 | France . | |
| 1182892 | 5/1968 | United Kingdom | 269/32 |

*Primary Examiner*—David Jones

[57] ABSTRACT

The invention relates to a clamping device for the clamping of at least one piece of tooling, for instance an upper tooling or a press, which device comprises:

two clamping jaws moveable towards and away from one another, between which the tooling can be clamped, pressure means, for instance at least one hydraulic cylinder for pressing the clamping jaws towards one another with force at energizing thereof, and at least one locking element present between the clamping jaws for co-action with an edge present on the tooling, such that the tooling in the absence of energizing of the pressure means can be pushed with at least one edge over the locking element, hook over the edge, and thus prevents the tool from falling, and is characterized in that a resilient strip, which is attached between the clamping jaws to one clamping jaw and which as a result of its own resilience lies in untensioned state at a distance from a pressure surface of this clamping jaw, whereby in the absence of energizing of the pressure means, the tooling can, through a sufficiently great tilting round a portion provided with a locking edge, be carried with its edge in and out of engagement with the locking edge and can pass over the locking edge, and to such a resilient strip.

8 Claims, 5 Drawing Sheets

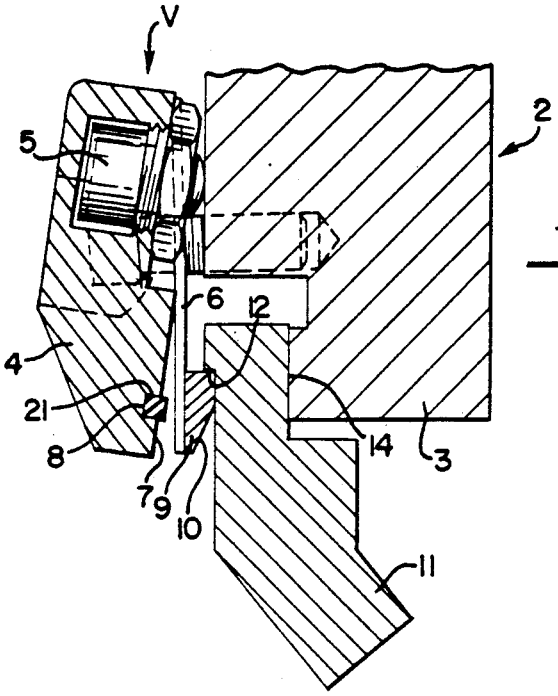
FIG. 2
FIG. 3
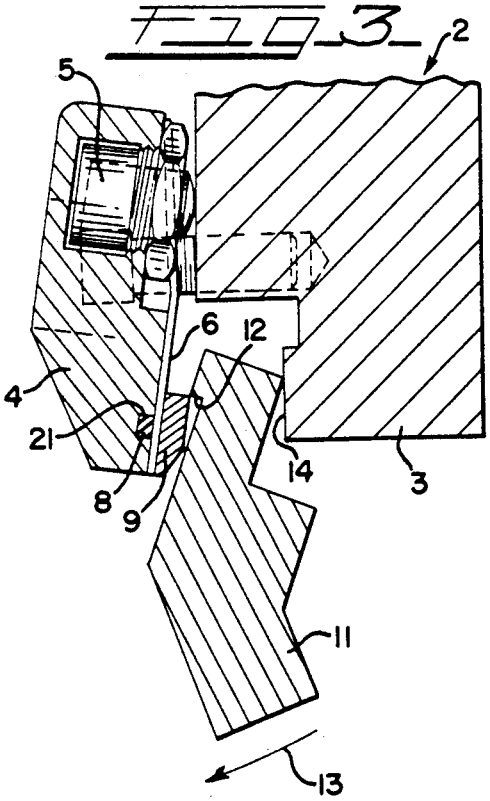
FIG. 4
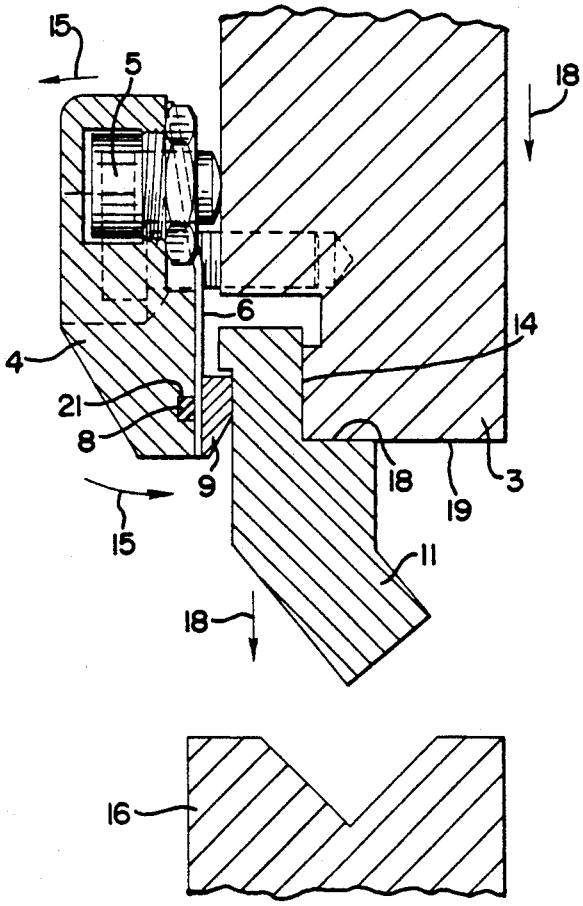

CLAMPING DEVICE

The invention relates to a clamping device for the clamping of at least one article of tooling, for instance an upper tooling of a press, which device comprises:

two clamping jaws moveable towards and away from one another, between which the tooling can be clamped, pressure means, for instance at least one hydraulic cylinder for pressing the clamping jaws towards one another with force at energizing thereof, and at least one locking element present between the clamping jaws for co-action with an edge present on the tooling, such that the tooling in the absence of energizing of the pressure means can be pushed with at least one edge over the locking element, hook over the edge, and thus prevents the tool from falling.

Such a clamping device for the upper tooling of presses is known from DE-A-35 24 694. In this known clamping device there is present a row of locking elements in the form of spring-loaded pins, over which an upper tooling of a press can be pushed over a rise surface, after which the upper edge of a lengthwise recess of the upper tooling is displaced over the free end of the spring-loaded pin, such that this pin is constrained by the spring force into its most outwardly protruding position and fixedly grips the tool, and in any case prevents it from falling.

The use of these spring-loaded pins has the drawback that after a number of reciprocating movements the pins can begin to move less easily in their guide sleeves. In the case of jamming in the most outward located position the relevant tool can no longer be removed from the clamping device or only with great difficulty, while in the case of jamming in the most inwardly located position the pin no longer functions as a locking element.

The invention now has for its object to embody a clamping device such that the above mentioned drawbacks are avoided, and the locking element can be attached to a clamping jaw and/or the resilient strip, thus creating great freedom in the embodying of the tool for clamping with regard to the manner of insertion, the positioning of the pressure surface etc., while the tools can be changed quickly or even used in reversed position, and even after a very large number of operation cycles there is no danger whatever of jamming or ageing.

To this end the clamping device according to the invention displays the characteristic that a resilient strip is present, which is attached between the clamping jaws to one clamping jaw and as a result of its own resilience lies in untensioned state at a distance from a pressure surface of this clamping jaw, whereby in the absence of energizing of the pressure means, the tool can, through a sufficiently great tilting round a part provided with a locking edge, be carried with its edge in and out of engagement with the locking edge and can pass the locking edge.

In order to distribute the positioning forces as well as possible, the embodiment is recommended in which the locking edge is the upper edge of a locking projection.

For easy insertion of the tool without the prior necessity of carrying out a determined tilting for this purpose, the variant can serve in which the locking projection has a rise surface for the insertion of the tool.

For the best possible distribution of forces and a homogeneous positioning between both clamping jaws of a tool, and particularly of a series of tools of possibly slightly differing mutual thicknesses, the embodiment can be advantageous in which a flexible strip is fitted between the pressure surface of the clamping jaw and the resilient strip.

In this some respect use can be made of another embodiment in which the resilient strip consists of segments. In this respect it is noted that for a homogeneous clamping of a series of tools situated in one row, such as the upper tooling of a press, the segments are preferably of a length such that they are at most just as long as the shortest toolings to be used.

Each segment of the resilient strip can be individually produced and arranged in the clamping device. A number of segments are however preferably joined together in one strip portion at a time. To this end the clamping device can display the feature that the resilient strip has incisions separating the segments.

For the clamping of tools of unequal thicknesses the embodiment can also be used in which the pressure surface of the relevant clamping jaw has for instance a waved shape such that when the tool is clamped the lower resilient bend displays a curve such that it can take over the function of the flexible strip. In this case the use of the flexible strip between the pressure surface of the relevant clamping jaw and the resilient strip can if desired be dispensed with.

The invention also relates to a resilient strip with a locking edge that is evidently intended as part of a clamping device according to the invention.

The invention will now be elucidated with reference to the annexed drawing. Herein:

FIG. 2 is a cross-section on enlarged scale of a clamping device according to the invention which forms part of the device according to FIG. 1;

FIG. 3 shows the clamping device as according to FIG. 2 during the removal of the tool;

FIG. 4 shows the clamping device according to the FIGS. 2 and 3 during energizing of the pressure means;

FIG. 1 shows a press 1 with a clamping device 2 according to the invention. This press is otherwise of known construction and will therefore not be discussed further within the framework of the invention.

Figure 1:
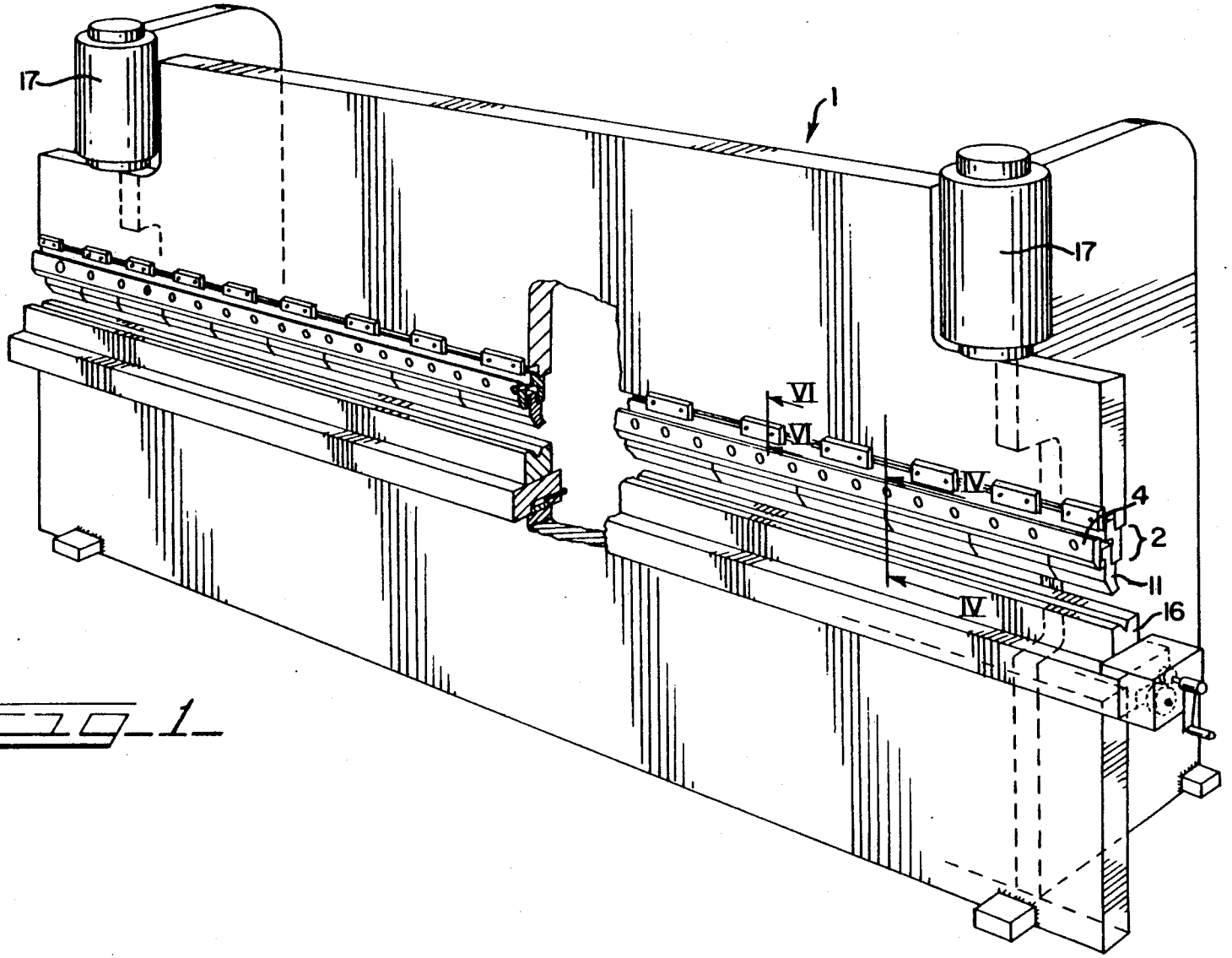
FIG. 1 shows a partially broken away perspective view of a press.

FIG. 2 shows the clamping device 2. This comprises a fixed clamping jaw 3 and a clamping jaw 4 pivotable relative thereto. By means of hydraulic cylinders 5 the pivotable clamping jaw 4 can be moved in relation to the fixed clamping jaw 3, as will be described hereafter with reference to FIGS. 3 and 4.

The pivotable clamping jaw 4 bears a resilient strip 6, which, in the manner shown in FIG. 2, in its untensioned state is at a distance at its lowest zone from the pressure surface 7 of the clamping jaw 4. In this lowest zone the clamping jaw 4 is provided with a flexible plastic strip 8 arranged in a groove 21.

On its underside the strip 6 bears a locking projection 9 with a sloping rise surface 10. An article of tooling 11, in this case the upper tooling of a press 1, can be carried with an edge 12 via the rise surface 10 over the projection, whereby the dimensioning is such that the upper portion of the tool 11 can be pushed in between the projection 10 and the pressure surface 14 of the fixed clamping jaw 3. This is the situation shown in FIG. 2. This stable situation prevents a tool 11 that has been pushed over the projection 10 from falling out of the clamping device 2, without energizing of the hydraulic cylinders serving as pressure means being necessary for this purpose.

FIG. 3 shows the situation in which the tool 11 must be taken from the situation shown in FIG. 2 out of the clamping device 2. To this end a tilting of the tool 11 is performed in the direction indicated by the arrow 13, while the user pulls the tool slightly downward. As a result the edge 12 can pass over the upper edge of the locking projection 9 and be taken out.

FIG. 4 shows the situation in which the hydraulic cylinders 5 are energized by way of means not drawn. As a result of this energizing the clamping jaw 4 pivots relative to the clamping jaw 3 in the direction indicated by the arrows 15, which results in the upper tooling 11 being pressed, on the one side against the pressure surface 14 of the fixed clamping jaw 3 and on the other side against the pressure surface 7 of the pivotable clamping jaw 4, via the projection 9, the strip 6 and the flexible strip 8.

Since, as FIG. 4 shows, the upper tooling 11 can co-act with a lower tooling 16 by setting the clamping device 2 in downward motion with force in the direction of arrow 18 by means of hydraulic cylinders 17 (see FIG. 1), the upper tooling 11 is formed in combination with the fixed jaw 3 such that the upper tooling 11 lies with a pressure surface 18 against the lower surface 19 of the fixed clamping jaw 3.

Figure 5:
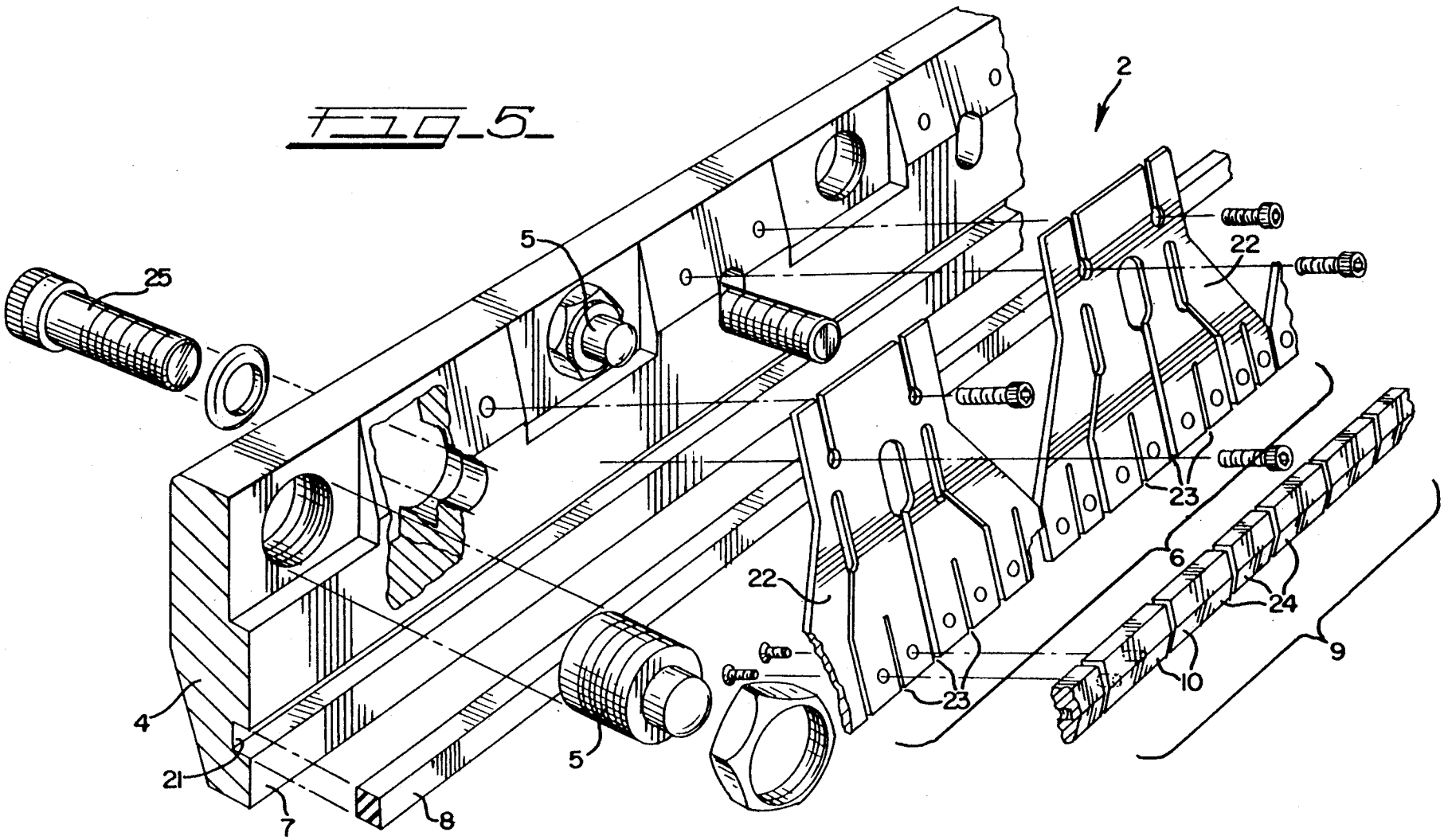
FIG. 5 is a partially broken away, perspective, exploded view in which is shown the construction of the clamping device according to the invention.

FIG. 5 shows an exploded view of the clamping device 2. As this figure shows, the strip 6 consists of portions 22, which are provided with incisions indicated generally by 23, which bound resilient segments. The locking projection 9 consists of projection segments 24 corresponding with the dimensions of the portions 22.

Figure 6:
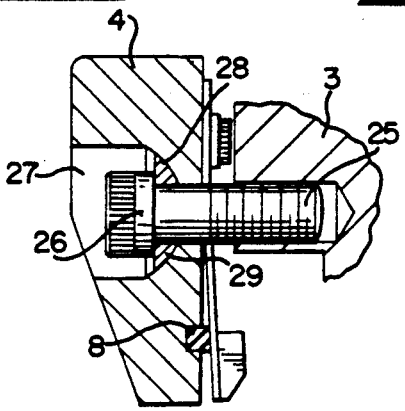
FIG. 6 is the cross-section VI according to FIG. 1.

Bolts 25 serve to hold the clamping jaw 4 in place pivotably relative to the fixed clamping jaw 3. As is shown clearly in FIG. 6, the pivotable clamping jaw 4 shows a recessing 27 with a spherical bottom 28 co-acting with the bolt head 26. Between the bolt head 26 and the spherical bottom 28 a similarly shaped ring 29 is situated such that the pivot axis thereby obtained corresponds with the line through the centres of curvature of spherical bottoms 28 of the recessings 27, the rotation centres of which all lie in one line.

The embodiment according to FIGS. 2–5 shows a clamping jaw 4 with a waved shape. The strip 6 that is straight in the rest position displays a curving in its pressed condition as in FIG. 4.

Figure 7:
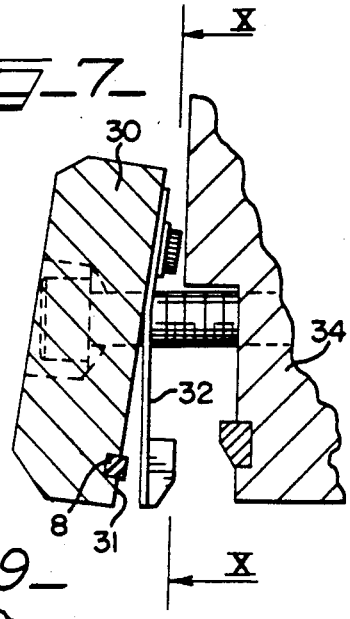
FIGS. 7, 8 and 9 are cross-sections through a variant in diverse positions.

The embodiment according to FIG. 7 is in respect of this aspect different insofar that the pivotable clamping jaw 30 has a straight front surface, while the resilient strip 32 has a curved shape, as a result of which the desired mutual distance between this strip 32 and the front surface 31 is once again obtained in the rest position.

Figure 8:
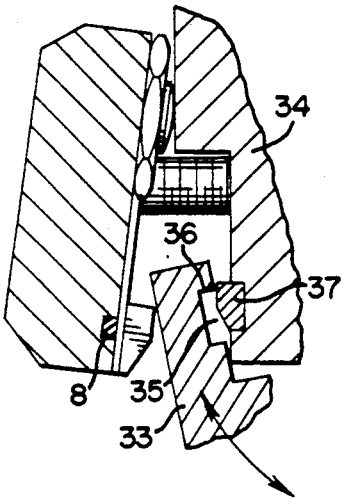
Figure 9:
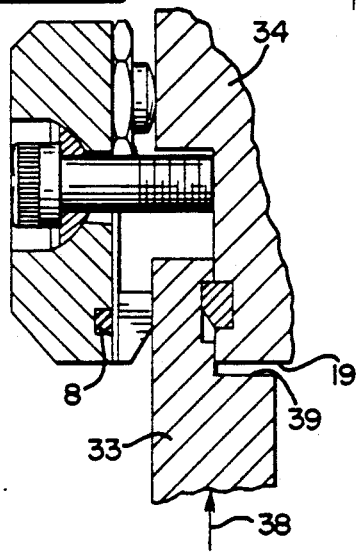

FIG. 8 shows the manner in which a tool 33 can be introduced between the moveable clamping jaw 30 and the fixed clamping jaw 34. The tool has a cut-away portion 35 with an upper edge 36 for co-action with a rise projection 37 arranged on the fixed clamping jaw 34. The clamping is shown in phases in FIGS. 7, 8 and 9. It is noted with regard to FIG. 9 that the tool 33 when clamped assumes in this situation a more or less fixed position. By exerting the pressure force indicated by the arrow 38 when the ready for use device is first set into operation the pressure surface 39 is pressed against the lower surface of the fixed clamping jaw 34, which results in the tool 33 being brought into position.

Figure 10:
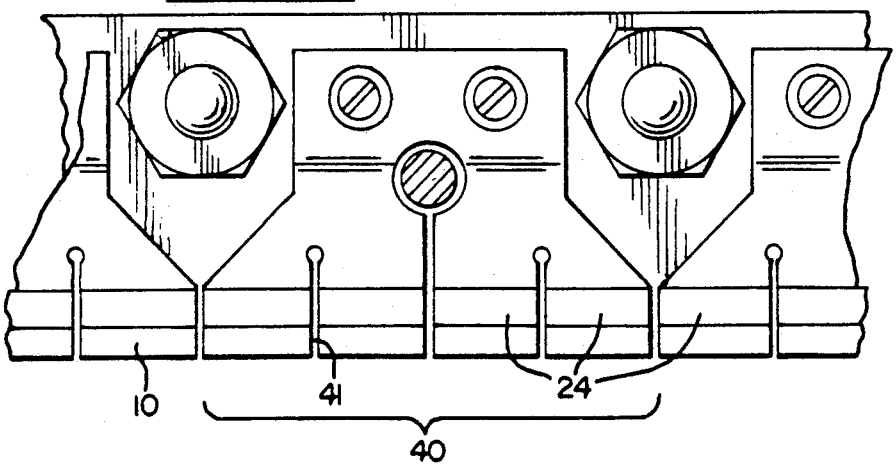
FIG. 10 shows the view X—X according to FIG. 7.

FIG. 10 shows an alternative, whereby strip portions 40 are provided with other incisions 41. This makes apparent that the designer has a certain freedom within the scope of the invention, for example also in the choice of material, metal or plastic.

Figure 11:
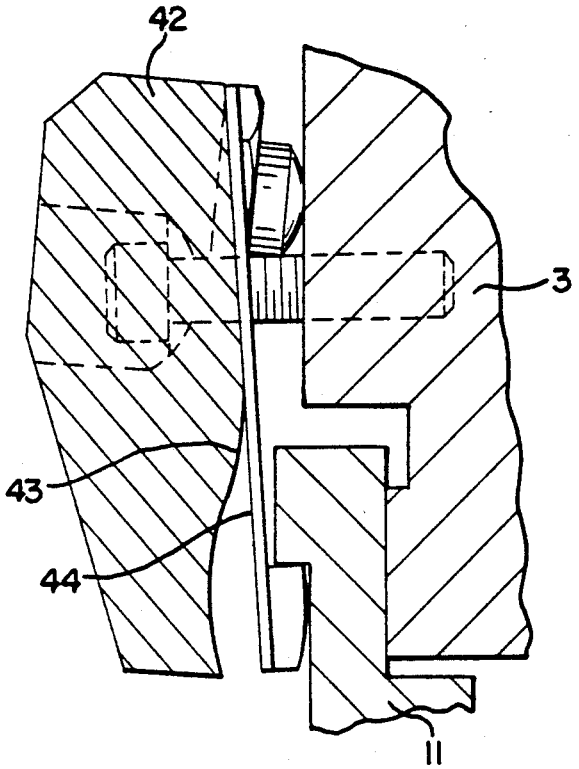
FIG. 11 is a view of a variant corresponding with FIG. 7.
Figure 12:
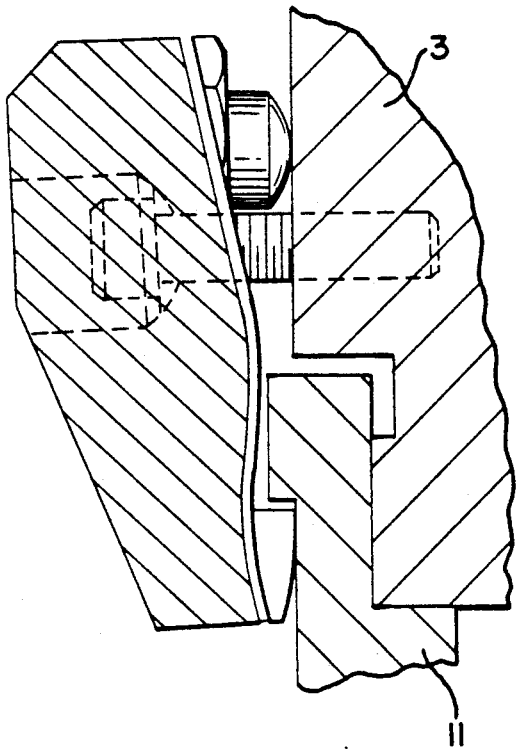
FIG. 12 shows the embodiment according to FIG. 11 during energizing of the pressure means.

The embodiment according to FIGS. 11 and 12 corresponds with the clamping device 2 insofar that it can be said to be a clamping jaw 42 with a waved front surface 43. As can be seen from FIGS. 11 and 12, the shaping and resilience of the strip 44 can achieve reliable clamping of tools 11 of unequal thickness. In this embodiment the plastic strip 8 can be dispensed with, as mentioned above.

I claim:

1. A clamping device for clamping at least one article comprising:

clamping means mounted to a support structure comprising first and second clamping jaws movable toward and away from one another;

pressure means associated with the support structure for pressing the first and second clamping jaws together;

a resilient strip positioned between the first and second clamping jaws and mounted to the first clamping jaw, the resilient strip having a first surface facing the first clamping jaw and a second surface facing the second clamping jaw, a portion of the resilient strip being separated from the first clamping jaw when the strip is not under stress; and locking means positioned between the clamping jaws and mounted to the second surface of the resilient strip, the locking means comprising at least one locking element for coaction with the article, the locking element comprises a locking member having an upper edge for coaction with a locking projection on an article such that the locking projection on the article can be hooked over the upper edge of the locking member to prevent release of the article.

2. The clamping device of claim 1 wherein the pressure means comprises at least one hydraulic cylinder mounted to the support structure and means associated with the hydraulic cylinder for energizing the cylinder to cause the first and second clamping jaws to press together with force.

3. The clamping device of claim 1 wherein the locking member also has a sloping rise surface for facilitating insertion of the article between the first and second clamping jaws.

4. The clamping device of claim 1 further comprising a flexible strip mounted between the resilient strip and the first clamping jaw.

5. The clamping device of claim 1 wherein the resilient strip comprises a plurality of segments.

6. The clamping device of claim 5 wherein the segments of the resilient strip are at least partially separated by incisions.

7. The clamping device of claim 1 wherein the first clamping jaw comprises a pressure surface having a waved portion and a substantially flat portion, the resilient strip being mounted to the substantially flat portion of the pressure surface and separated from the waved portion when the strip is not under stress.

8. In a clamping device for clamping at least one article between a first clamping jaw and a second clamping jaw, the improvement comprising a resilient strip, the resilient strip having:

a first end for mounting the resilient strip to the first clamping jaw;

a second end for mounting a locking member to the resilient strip, the locking member having an upper edge for coaction with a locking projection on an article such that the locking projection on the article can be hooked over the upper edge of the locking member to prevent release of the article;

a first surface facing the first clamping jaw in a position adjacent to the first clamping jaw at the mounting end and separate from the first clamping jaw at the locking end when the resilient strip is not under stress;

a second surface facing the second clamping jaw of the clamping device;

means for mounting the resilient strip to the first clamping jaw at the mounting end of the strip; and means for mounting a locking member to the second surface of the resilient strip at the locking end of the strip.

* * * * *

UNITED STATES PATENT AND TRADEMARK OFFICE

CERTIFICATE OF CORRECTION

PATENT NO. : 5,022,256

DATED : June 11, 1991

INVENTOR(S) : Jan van der Meulen

It is certified that error appears in the above-identified patent and that said Letters Patent is hereby corrected as shown below:

Title page:

IN THE REFERENCES CITED

On the cover page under the heading "U.S. PATENT DOCUMENTS", please delete "2,956,813" and substitute therefor --3,956,813--.

Column 2, line 8, delete "some" and insert --same--.

Signed and Sealed this

Second Day of March, 1993

*Attest:*

STEPHEN G. KUNIN

*Attesting Officer*

*Acting Commissioner of Patents and Trademarks*

UNITED STATES PATENT AND TRADEMARK OFFICE

CERTIFICATE OF CORRECTION

PATENT NO. : 5,022,256

DATED : June 11, 1991

INVENTOR(S) : Jan van der Meulen

It is certified that error appears in the above-identified patent and that said Letters Patent is hereby corrected as shown below:

IN THE ABSTRACT

In line 3, please delete "or" and substitute therefor --of--; and delete ", which device comprises" and substitute therefor --. The clamping device has--.

In line 14, please delete "means" and substitute therefor --created by the hydraulic cylinders--.

In line 16, please delete "prevents" and substitute therefor --prevent--; and after "falling" please delete "," and substitute therefor --.--.

In line 17, please delete "and is characterized in that".

In line 18, before "resilient" please delete "a" and substitute therefor --A--.

In lines 19 and 20, please delete "and which as a result of its own resilience".

In line 22, after "jaw" please delete "," and substitute therefor --.--.

In lines 22 and 23, please delete "whereby in the absence of energizing of the pressure means," and substitute therefor --Without activating the hydraulic cylinders--.

UNITED STATES PATENT AND TRADEMARK OFFICE

CERTIFICATE OF CORRECTION

PATENT NO. : 5,022,256

DATED : June 11, 1991

INVENTOR(S) : Jan van der Meulen

It is certified that error appears in the above-identified patent and that said Letters Patent is hereby corrected as shown below:

In line 27, after "edge" please delete ", and"; and delete "such a" and substitute therefor --the--.

Signed and Sealed this

Seventh Day of December, 1993

*Attest:*

*Attesting Officer*

BRUCE LEHMAN

*Commissioner of Patents and Trademarks*